US006703995B2

(12) United States Patent
Bird et al.

(10) Patent No.: US 6,703,995 B2
(45) Date of Patent: Mar. 9, 2004

(54) BISTABLE CHIRAL NEMATIC LIQUID CRYSTAL DISPLAY AND METHOD OF DRIVING THE SAME

(75) Inventors: Neil C. Bird, Horsham (GB); David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 254 days.

(21) Appl. No.: 09/955,856

(22) Filed: Sep. 19, 2001

(65) Prior Publication Data

US 2002/0067323 A1 Jun. 6, 2002

(30) Foreign Application Priority Data

Oct. 5, 2000 (GB) ..... 0024488

(51) Int. Cl.[7] ..... G09G 3/36
(52) U.S. Cl. ..... 345/87; 345/99
(58) Field of Search ..... 345/87, 76, 94, 345/90, 208, 89, 97, 96, 99, 98, 100; 315/169.3; 313/506; 359/101; 327/91

(56) References Cited

U.S. PATENT DOCUMENTS 5,570,216 A * 10/1996 Lu et al. ..... 349/175
6,175,345 B1 * 1/2001 Kuribayashi et al. ..... 345/76
6,204,835 B1 * 3/2001 Yang et al. ..... 345/94
6,268,839 B1 * 7/2001 Yang et al. ..... 345/89
6,268,840 B1 * 7/2001 Huang ..... 345/94

* cited by examiner

*Primary Examiner*—Vijay Shankar
*Assistant Examiner*—Nitin Patel

(57) ABSTRACT

A bistable chiral nematic liquid crystal display has pixel address circuits which comprise a first switching device (14) for switching a supply voltage to the remainder of the pixel address circuit and which is controlled by a row address line (10) and a second switching device (16) for allowing or preventing the supply voltage to be provided to the respective portion of the liquid crystal material (18), and Controlled by a column select line (32). This pixel layout and a method of driving the pixel address circuit, including use of a sample and hold circuit, enables a transition of the liquid crystal to the homeotropic or H state to be avoided when the pixel material is desired to remain in the P or FC states between frames, so that the black addressing bar artifact can be avoided.

8 Claims, 3 Drawing Sheets

BISTABLE CHIRAL NEMATIC LIQUID CRYSTAL DISPLAY AND METHOD OF DRIVING THE SAME

The present invention concerns a display utilizing a chiral nematic reflective bistable liquid crystal material, and a method of driving such a display. This material is also described as cholesteric. In particular, the invention relates to an active matrix pixel arrangement and drive scheme.

Cholesteric liquid crystal material is a reflective material that provides a strongly colored binary image. The material is bistable, has a very wide viewing angle and does not require polarisers, color filters or rubbing as do super twisted nematic (STN) type displays. Therefore, the material can provide a low power and low cost display at high resolution and with a good quality single color image. This type of display is being proposed for hand-held portable devices as well as for electronic document viewers, such as electronic book or newspaper devices.

Cholesteric materials have three stable states. The Planar (P) state is a reflective state of the material, and is stable with zero applied field. The Focal Conic (FC) is a transmissive scattering state of the material, and is also stable with zero applied field. The Homeotropic (H) state is stable only above a high threshold voltage of around 30V, and is also transparent. A black absorbing layer placed behind the material means that the H and FC states appear black.

A fourth, instable, state also exists, which can occur upon relaxation of the material from the H state. This is called the Transient Planar (P*) state. This state only arises if the high voltage on the material in the H state is reduced rapidly, for example in 2 ms or less. The Transient Planar state relaxes to the Planar state (P) in the absence of applied voltages.

In use of the material, a drive scheme is devised to switch the material between the P and FC states, which are stable at zero applied voltage. A first problem arises because any transition between the P and FC states requires the material to pass through the high-voltage H state. Therefore, known passive matrix switching schemes require rapid high voltage switching. Conventional drive schemes are arranged such that each time a pixel is addressed, a transition in the material is provoked into the H state. This means that pixels in the reflective P state are caused to pass through the transmissive H state, even if the pixel is to be driven to the reflective P state in the next field period. This gives rise to a visual artifact known as a black addressing bar.

A further problem with this material results from the slow response time. For example, voltages need to be applied for at least 20 ms to enable state transition of the material into the H state. The material also has strong temperature dependence.

The bistable nature of the material at zero applied voltage means a display using the material does not require continuous updating or refreshing. If display information does not change, the display can be written once and remain in its information-conveying configuration for extended periods with no power consumption. This has resulted in use of cholesteric liquid crystal displays for images that can be slowly updated over relatively long periods of time. However, the problems outlined above, particularly the slow addressing response, have limited the further development of this display technology in wider fields of application.

U.S. Pat. No. 5,748,277 discloses a passive matrix addressing scheme for cholesteric displays which seeks to reduce the addressing time. The scheme relies upon the rapid transition from the H state to the P* state. If there is rapid voltage turn-off, a transition to the P* is achieved (and in turn a transition to the P state), whereas if there is slow voltage turn off, then a transition to the FC state takes place.

The drive scheme provides an address voltage profile which has three phases. These three phases are known as "preparation", "selection" and "evolution". The preparation phase places the liquid crystal material in the Homeotropic state, and is achieved by applying a high voltage, typically 35V, to the row of pixels for about 50 ms. The selection phase is only 1 ms long and dictates whether there is rapid or slow voltage turn off. The voltage applied to the row is typically 7V, and the column voltage is in the range −3V to +3V. During this phase, the voltage applied to the column determines which state the pixel will end up in. The evolution phase allows the liquid crystal material to relax to the Planar or Focal Conic state, as determined by the preceding selection phase. During this phase, a voltage of 25V may be applied, typically for 40 ms. At the end of the three phase process, the voltage across the liquid crystal material is returned to zero.

The preparation and evolution phases can be carried out simultaneously for adjacent rows, so that, for a large number of rows, the average row address period will tend towards the selection phase duration of 1 ms.

In common with other liquid crystal materials, the LC state is determined by the RMS voltage across the LC cell, whereas the average voltage across the cell should be zero to prevent electrochemical degradation. For this purpose, the row voltages are arranged as AC pulse trains so that the RMS voltage is non-zero, whereas the average voltage is zero. Typically, the frequency of the row voltage signals will be 1000 Hz, so that the selection phase comprises a single wavelength signal of 1 ms duration. This imposes a large number of high voltage transitions on the row electrodes which consume power.

Whilst this three-phase addressing scheme improves the addressing time, it does not address the other issues of rapid high voltage switching or of the black addressing bar.

According to the invention, there is provided a display apparatus comprising:

- a layer of bistable chiral nematic liquid crystal material
- an active matrix substrate defining rows and columns of pixel address circuits, each pixel address circuit having an output for applying a signal to a respective portion of the liquid crystal material,
- wherein each pixel address circuit comprises
- a first switching device for switching a supply voltage to the remainder of the pixel address circuit and which is controlled by a row address line;
- a second switching device for allowing or preventing the supply voltage to be provided to the respective portion of the liquid crystal material, and controlled by a column select line.

The switching devices of the pixel enable a transition to the H state to be avoided when the material is to remain in the P or FC states. In particular, if transition from the P state to the H state is avoided, the black addressing bar artifact can be avoided. The use of row address line for the control of the first switching device and a column select line for control of the second switching device enables the supply of the supply voltage to individual pixels to be controlled independently. The supply voltage is the voltage required to cause a transition of the cholesteric material to the H state.

A third switching device may be provided for switching a selection voltage to the pixel address circuit and which is controlled by a second row address line, the selection voltage being provided on a column line, the second switching device allowing or preventing the selection voltage to be provided to the respective portion of the liquid crystal material. This enables the selection phase to be implemented, but the second switching device still enables the voltage profile of the selection phase to be inhibited from reaching the liquid crystal material.

A fourth switching device may be provided for switching a ground voltage to the liquid crystal material and which is controlled by a third row address line. This maintains the pixel in the stable zero voltage state at the end of the phase transitions within the material.

A signal on the column select line may be provided to a sample and hold circuit, so that a short time is required to provide the signal to the pixel. This enables the column select line to provide signals for different rows of pixels in rapid succession. The second switching device may comprise a transistor, and the signal on the column select line is then a gate signal for the transistor. The sample and hold circuit preferably comprises a sampling transistor and a holding capacitor, a gate voltage being stored on the capacitor for controllably turning the transistor on or off.

A frame store may be provided for determining which pixels are to be provided with the supply voltage based on the pixel outputs in the previous and current frames.

The invention also provides a method of addressing a bistable chiral nematic liquid crystal display apparatus, the apparatus comprising an active matrix substrate defining rows and columns of pixel address circuits, each pixel address circuit having an output for applying a signal to a respective portion of the liquid crystal material, the method comprising:

selecting a row of pixels thereby providing a supply voltage to each pixel, the supply voltage being sufficient to cause the liquid crystal material to reach a homeotropic state;

determining which pixels require the respective portion of the liquid crystal material to have the supply voltage applied to them, those pixels which were in a reflecting planar state in the previous frame and which are to remain in a reflecting planar state in the current frame being determined as not requiring the supply voltage;

providing the supply voltage to those pixels determined to require the supply voltage which places the liquid crystal material in the Homeotropic state;

providing a selection voltage to those pixels determined to require the supply voltage, the selection voltage determining whether the liquid crystal material relaxes to the Focal Conic or Planar state; and providing voltages to allow relaxation of the liquid crystal material from the Homeotropic state.

The method enables the black addressing bar artifact to be eliminated, and avoids rapid switching of high voltages. However, the average voltage may still be zero, by making the supply voltage positive for some frames and negative for other frames.

Examples of the invention will now be described in detail with reference to the accompanying drawings, in which.

The definition of "rows" and "columns" is somewhat arbitrary in the following description and claims. These terms are intended only to signify a two dimensional array of elements, with groups of elements aligned with two orthogonal axes. Thus, a row or column may run from side to side or from top to bottom of a display.

Figure 1:
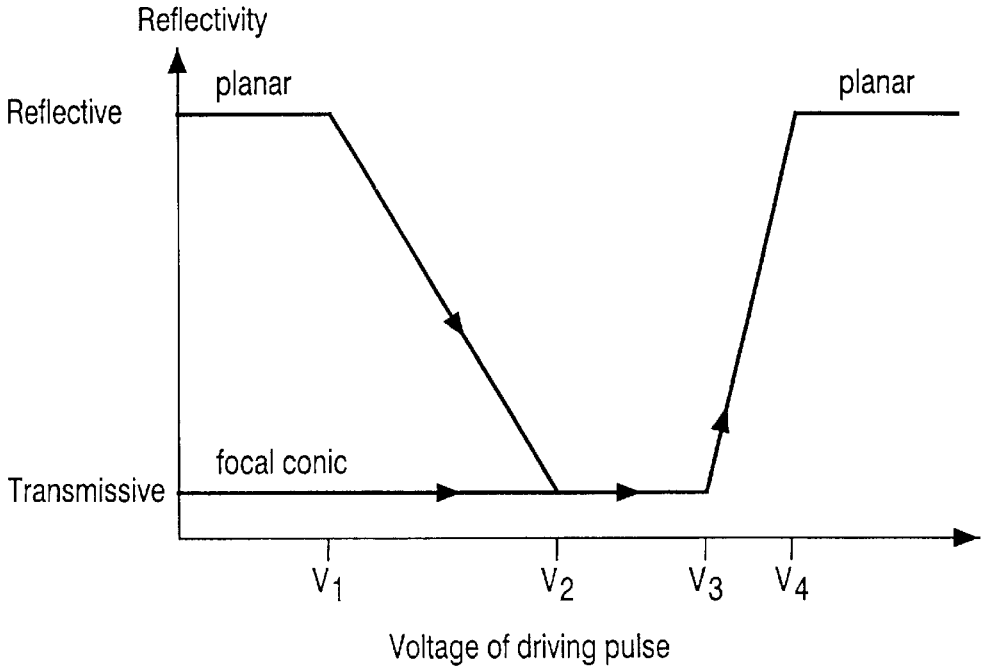
FIG. 1 shows the electro-optical response of a bistable reflective cholesteric liquid crystal.

FIG. 1 shows the electro-optical response of a bistable reflective cholesteric liquid crystal. The curves show the reflectivity after application of a square wave pulse of given voltage starting either in the stable low-voltage Planar or Focal Conic state. A voltage below $V_1$ does not change the state of the material. A voltage pulse between $V_2$ and $V_3$ switches the material to the Focal Conic state, and a voltage above $V_4$ results in the Planar state. To use the material in a liquid crystal display, the material is driven to the stable Planar or Focal Conic states with low applied voltage ($<V_1$). However, to switch between the Planar and Focal Conic states, the material must be driven to a high voltage state (not shown in FIG. 1) in which the material is transmissive. The conditions under which this high voltage is then removed from the material dictate the manner in which the material relaxes to the stable low voltage state. If the voltage is removed rapidly, the material passes through the Transient Planar state before relaxing to the stable Planar state. If the high voltage is removed more slowly, the material relaxes to the Focal Conic low-voltage stable state.

Conventional drive schemes for cholesteric displays use a passive matrix addressing scheme, which is possible as a result of the memory effect of the liquid crystal. During each field period of the addressing scheme, the material is caused to pass into the transmissive Homeotropic state. This gives rise to the black addressing bar artefact described above.

The invention provides an active matrix addressing scheme in which the high voltage supplied to rows of pixels is selectively switchable on to the liquid crystal material of each pixel in the row. Thus, it is possible to dictate for each pixel whether or not it passes to the Homeotropic state. For pixels which are in the reflective Planar state and which are to remain in the reflective Planar state, inhibiting the Homeotropic state avoids the black addressing bar problem.

Figure 2:
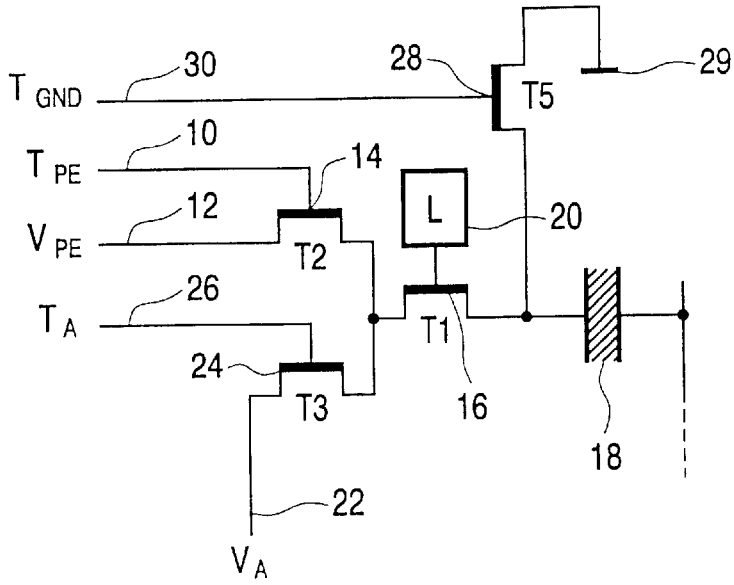
FIG. 2 shows an active matrix pixel circuit for a cholesteric display in accordance with the invention.

FIG. 2 shows a first active matrix pixel design of the invention. Each pixel is addressed by a first row conductor 10 "$T_{pE}$" which is used to address a row of pixels, and allow the high supply voltage to be supplied to the liquid crystal material from the voltage line 12 "$V_{PE}$". This voltage line 12 carries the voltages for the preparation and evolution phases. The row conductor 10 is coupled to the gate of a first transistor 14 which either allows or prevents the voltage from the line 12 being provided to the remainder of the pixel address circuit. When a row of pixels is addressed by the row conductor 10, all of these transistors 14 in the row are turned on so that the supply voltage reaches the remainder of the pixel address circuit for each pixel in that row. A second transistor 16 allows or prevents the voltage at the output of the transistor 14 being provided to the cholesteric liquid crystal cell 18, and the gate of this second transistor 16 is provided by a latching arrangement 20, the implementation of which will be described further below.

The row address line 10 and the latching arrangement 20 together allow the supply voltage for the preparation and evolution phases to be provided to or isolated from individual pixels within each row. This enables certain pixels to be isolated from these voltages so that these pixels are not caused to enter the Homeotropic state. In particular, if a pixel is to be driven from the reflective state in one field period to the reflective state in the next field period, the second transistor 16 is turned off by the latching arrangement 20. Of course, this requires a field store so that the current state of the pixels can be remembered.

As described above, for those pixels where the cholesteric material is driven to the Homeotropic state, the discharge conditions from the Homeotropic state dictate whether the pixel returns to the transmissive Focal Conic state or to the reflective Planar state.

As in the passive matrix addressing scheme described above, a selection voltage is applied to the liquid crystal material for this purpose. The selection voltage $V_A$ is provided on a column line 22, and is switched to or isolated from the input of the second transistor 16 by a third transistor 24. The gate signal for this third transistor is provided by a third row conductor 26 "$T_A$". A fourth transistor 28 enables a ground voltage 29 to be switched to the liquid crystal material 18, and this is controlled by a fourth row conductor 30 "$T_{GND}$". This provides the zero voltage stable operation of the material at the end of the state transitions.

The preparation and evolution voltages provided on the voltage line 12 may be DC levels, which results in a lower power addressing method than the conventional passive matrix addressing scheme. There is, however, still a need to ensure that the average voltage across the liquid crystal cell is zero, and this is achieved by alternately addressing the pixel using positive and negative supply voltages (of 35 volts for example) for the preparation phase and the evolution phase, in successive frames.

As described above, the latching arrangement 20 enables the black bar effect to be removed, by enabling control of whether the material is driven into the Homeotropic state. The implementation of the latching circuit 20 is shown in greater detail in FIG. 3. Where FIG. 3 shows the same components as in FIG. 2, the same reference numbers are used, and the description is not repeated.

The latching arrangement 20 receives a latch signal from a column select line 32. This latch signal "$V_{SEL}$" is effectively a gate voltage for the second transistor 16, and thereby determines whether that transistor is turned on or off, which in turn determines whether the voltage at the input 17 of that transistor is transferred to the liquid crystal material 18. The latching arrangement 20 acts as a sample and hold circuit which samples the voltage on the column select line 32. For this purpose, a sampling transistor 34 is provided which, during a sampling period, charges a holding capacitor 36 to a voltage corresponding to the voltage on the column select line 32. This capacitor 36 is connected between the gate of the second transistor 16 and ground 29. Therefore, during a sampling period, a voltage is stored by the capacitor 36 on the gate of the second transistor 16 which is sufficient either to turn on the transistor 16 or else ensures the transistor 16 remains turned off. The use of a sample and hold circuit enables the latching signal on the column select line 32 to be provided to the row of pixels for a very short period of time, so that the rows of pixels may be addressed in rapid succession. The sampling operation is controlled by a further row conductor 37 "$T_{SEL}$", so that for each pixel in a row, the latching signal is provided simultaneously and stored on the respective holding capacitor 36.

Figure 3:
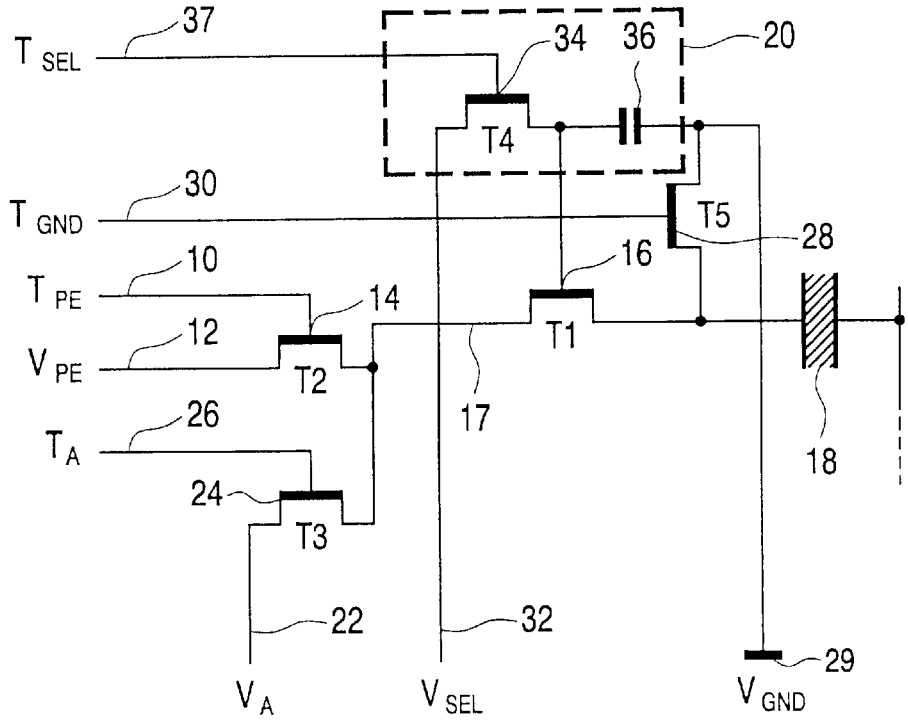
FIG. 3 shows the pixel circuit of FIG. 2 in greater detail.
Figure 4:
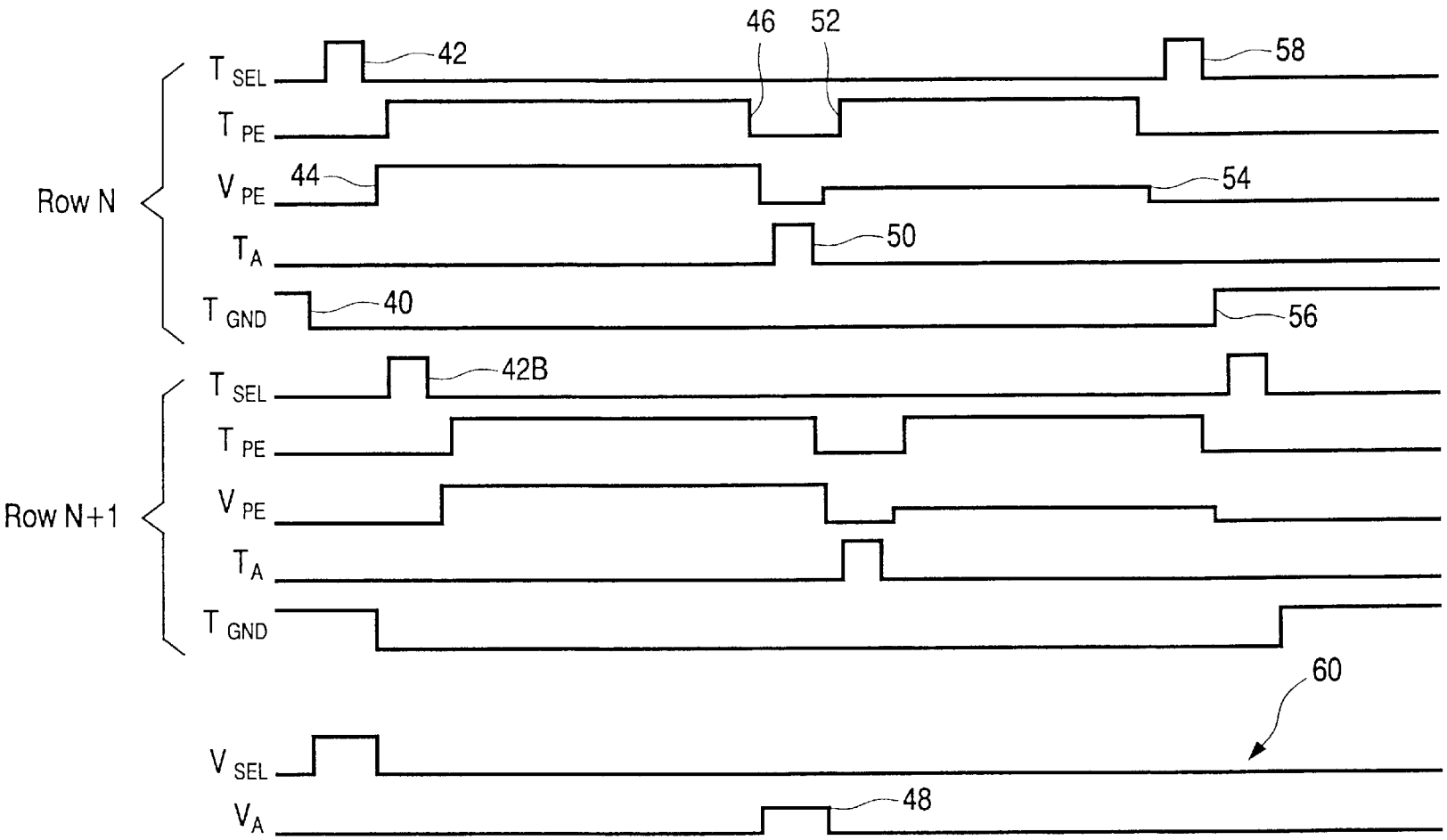
FIG. 4 is a timing diagram for the circuit of FIG. 3.

FIG. 4 is a timing diagram illustrating the operation of the circuit of FIG. 3, for addressing two successive rows of pixels of the display.

Initially, the transistor 28 is turned on by the row conductor 30 "TGND", and this sets the voltage across the liquid crystal cell 18 to zero, which maintains the cell in the stable operating state, either in the Planar or Focal Conic states. When the addressing sequence starts, the transistor 28 is turned off by the falling edge 40 shown in FIG. 4. The holding capacitor 36 is then charged to a voltage dependent upon the voltage on the column select line 32 "$V_{SEL}$". In order to carry out the sample and hold operation of the latch 20, the row 37 "$T_{SEL}$" is provided with a pulse 42. In the example of FIG. 4, for row N the voltage $V_{SEL}$ is high which thereby charges the holding capacitor 36 to a voltage which is sufficient to turn the second transistor 16 on.

The preparation voltage is then applied to the second row conductor 12 as a voltage pulse 44 of, for example, 35 Volts. During this time, the first transistor 14 is switched on by the first row conductor 10 by means of pulse 46. In this way, the preparation voltage is supplied to the liquid crystal cell 18 through the second transistor 16. At the end of this preparation phase the first transistor 14 is switched off, and instead the selection pulse 48 provided on the column select line $V_A$ is switched through the transistor 24 to the liquid crystal material 18 by means of pulse 50 on the row conductor 26 "$T_A$".

At the end of the selection phase, the pixel enters the evolution phase and the first transistor 14 is switched on again by pulse 52 which passes the evolution voltage 54, for example 25 Volts, through the second transistor 16 to the cell 18.

At the end of the addressing sequence, the sampling transistor 34 is turned on briefly using pulse 58 with zero Volts on the column select line 32, as indicated by arrow 60. This ensures that zero volts is applied to the holding capacitor 36, to ensure that the second transistor 16 is then turned off. Finally, the leading edge 56 on the row conductor 30 ensures that there is no voltage across the cell 18 so that it remains in the low voltage stable state.

The waveforms for row N+1 shown in FIG. 4 represent the case when the liquid crystal cell 18 is not to be charged to the Homeotropic state. In this case, the voltage on the column select line 32 "$V_{SEL}$" remains low during the pulse 42B so that zero volts is stored on the holding capacitor 36 and the second transistor 16 will therefore not be turned on.

The overlap of the row addressing signals means that the effective row addressing time is equal to the length of the selection phase, typically 1 ms. For a large number of rows, the average row address period therefore tends towards duration of the selection phase.

The row waveforms do not illustrate the alternating voltages on the second row conductor 12. A voltage polarity reversal may be carried out once for every field period of the display, for example.

The invention enables the black bar phenomenon to be removed, but still provides a fast addressing scheme, where the average row address period tends towards the duration of a short selection phase. The rapid switching between positive and negative voltage levels is also avoided, which provides power savings.

Figure 5:
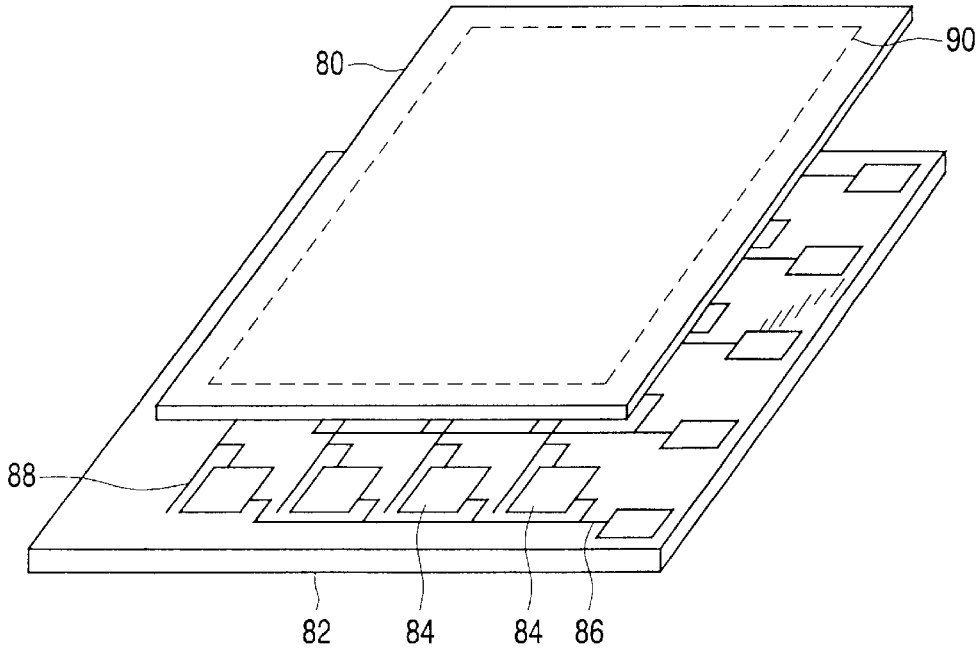
FIG. 5 shows a display according to the invention.

FIG. 5 shows a liquid crystal display device according to the invention. The device is provided with two glass substrates 80, 82 which face each other to hold liquid crystal material between them (not shown). The lower substrate 82 is the active plate which defines the pixel layout described above. Each pixel defines a contact pad 84 for the liquid crystal material. Each pixel is addressed by a number of row conductors 86 (only one of which is shown in FIG. 8) and a number of column conductors 88 (only one of which is again shown in FIG. 8). The upper substrate 80 carries a common earth potential layer 90, so that individual regions of the liquid crystal material have a potential defined across them which is dictated by the potential on the contact pad 84.

The active plate can be manufactured using known techniques, for example using the same processes used to form the active plate of a conventional active matrix liquid crystal display. Thus, the required transistors and capacitor are formed using thin film techniques, and the transistors may be defined as amorphous silicon or polycrystalline silicon devices.

Various modifications will be apparent to those skilled in the art.

What is claimed is:

1. A display apparatus comprising:

a layer of bistable chiral nematic liquid crystal material an active matrix substrate defining rows and columns of pixel address circuits, each pixel address circuit having an output for applying a signal to a respective portion of the liquid crystal material, wherein each pixel address circuit comprises a first switching device for switching a supply voltage to the remainder of the pixel address circuit and which is controlled by a row address line;

a second switching device for allowing or preventing the supply voltage to be provided to the respective portion of the liquid crystal material, and controlled by a column select line wherein a signal on the column select line is provided to a sample and hold circuit in communication with said second switching device.

2. Apparatus as claimed in claim 1, further comprising a third switching device for switching a selection voltage to the pixel address circuit and which is controlled by a second row address line, the selection voltage being provided on a column line, said third switching device in communication with said second switching device allowing or preventing the selection voltage to be provided to the respective portion of the liquid crystal material.

3. Apparatus as claimed in claim 1, further comprising a fourth switching device for switching a ground voltage to the liquid crystal material and which is controlled by a third row address line.

4. Apparatus as claimed in claim 1, wherein the second switching device comprises a transistor and wherein the signal on the column select line is a gate signal for the transistor, and wherein the sample and hold circuit comprises a sampling transistor and a holding capacitor, a gate voltage being stored on the capacitor for controllably turning the transistor on or off.

5. Apparatus as claimed in claim 1, wherein each switching device comprises a transistor.

6. Apparatus as claimed in claim 1, including a frame store for determining which pixels are to be provided with the supply voltage based on the pixel outputs in the previous and current frames.

7. A method of addressing a bistable chiral nematic liquid crystal display apparatus, the apparatus comprising an active matrix substrate defining rows and columns of pixel address circuits, each pixel address circuit having an output for applying a signal to a respective portion of the liquid crystal material, the method comprising:

selecting a row of pixels thereby providing a supply voltage to each pixel, the supply voltage being sufficient to cause the liquid crystal material to reach a homeotropic state;

determining which pixels require the respective portion of the liquid crystal material to have the supply voltage applied to them, those pixels which were in a reflecting planar state in the previous frame and which are to remain in a reflecting planar state in the current frame being determined as not requiring the supply voltage;

providing the supply voltage to those pixels determined to require the Supply voltage which places the liquid crystal material in the Homeotropic state;

providing a selection voltage to those pixels determined to require the supply voltage, the selection voltage determining whether the liquid crystal material relaxes to the Focal Conic or Planar state; and providing voltages to allow relaxation of the liquid crystal material from the Homeotropic state.

8. A method as claimed in claim 7, wherein the supply voltage is positive for some frames and negative for other frames.

* * * * *